US009765606B2

(12) United States Patent
Snow et al.

(10) Patent No.: US 9,765,606 B2
(45) Date of Patent: Sep. 19, 2017

(54) SUBTERRANEAN HEATING WITH DUAL-WALLED COILED TUBING

(71) Applicant: Baker Hughes Incorporated, Houston, TX (US)

(72) Inventors: Richard Snow, Chicago, IL (US); Silviu Livescu, Calgary (CA); Geoffrey Presley, Spokane, WA (US); Thomas J. Watkins, Calgary (CA)

(73) Assignee: BAKER HUGHES

( * ) Notice: Subject to any disclaimer, the term of this patent is extended or adjusted under 35 U.S.C. 154(b) by 410 days.

(21) Appl. No.: 14/600,981

(22) Filed: Jan. 20, 2015

(65) Prior Publication Data

US 2016/0208588 A1 Jul. 21, 2016

(51) Int. Cl.

| | |
|---|---|
| ***E21B 43/24*** | (2006.01) |
| ***E21B 36/04*** | (2006.01) |
| ***E21B 17/20*** | (2006.01) |

(52) U.S. Cl.

CPC ..... *E21B 43/2401* (2013.01); *E21B 17/206* (2013.01); *E21B 36/04* (2013.01)

(58) Field of Classification Search

CPC ... E21B 43/2401; E21B 36/04; E21B 17/2016
See application file for complete search history.

(56) References Cited

U.S. PATENT DOCUMENTS

| | | | | |
|---|---|---|---|---|
| 4,256,945 | A | 3/1981 | Carter et al. | |
| 6,015,015 | A | 1/2000 | Luft et al. | |
| 7,484,561 | B2 | 2/2009 | Bridges | |
| 8,210,256 | B2 | 7/2012 | Bridges | |
| 8,408,294 | B2 | 4/2013 | Bridges | |
| 2003/0141065 | A1 | 7/2003 | Karanikas et al. | |
| 2011/0259591 | A1 | 10/2011 | Vinegar | |
| 2012/0006444 | A1* | 1/2012 | Tupper | E21B 17/20 138/149 |
| 2012/0061380 | A1 | 3/2012 | Parsche | |
| 2014/0326504 | A1 | 11/2014 | Hay et al. | |

OTHER PUBLICATIONS

Sierra et al., "Promising Progress in Field Application of Reservoir Electrical Heating Methods," SPE Paper 69709, pp. 1-17 (2001).

* cited by examiner

*Primary Examiner* — Yong-Suk (Philip) Ro
(74) *Attorney, Agent, or Firm* — Shawn Hunter

(57) ABSTRACT

Hydrocarbon production from subterranean formations is stimulated by heating. A dual-walled coiled tubing radio frequency heating arrangement is described that can be disposed into a wellbore and energized to heat the surrounding formation.

17 Claims, 6 Drawing Sheets

SUBTERRANEAN HEATING WITH DUAL-WALLED COILED TUBING

BACKGROUND OF THE INVENTION

1. Field of the Invention

The invention relates generally to devices and methods for heating subterranean hydrocarbon-bearing formations.

2. Description of the Related Art

Thermal heating is needed or desired for extraction of some hydrocarbons. In formations that have heavy oils, heat is used to stimulate flow. Heating is also useful to help release oil from shale. Steam assisted gravity drainage ("SAGD"), for example, injects steam for extraction of hydrocarbons. Radio frequency ("RF") heating arrangements are discussed in U.S. Pat. Nos. 8,210,256 and 8,408,294 by Jack E. Bridges.

SUMMARY OF THE INVENTION

The invention provides systems and methods for providing heating of and stimulation for subterranean hydrocarbon-bearing formations. In described embodiments, RF heating techniques are employed by dual-walled coiled tubing arrangements. Coiled tubing is tubing that is sufficiently flexible that long lengths can be coiled onto a spool so that it can be injected into a wellbore using a coiled tubing injector. In particular embodiments, a dual-walled coiled tubing arrangement is described which includes an inner coiled tubing string and an outer tubing string that are formed of conductive material or which include conductive paths. The dual-walled structure can be assembled, coiled onto a spool, transported to a well location and injected into a well as a unit. Features useful for creating an effective downhole heater in this way are described.

The inner and outer coiled tubing strings are separated by one or more separators or isolators. In some embodiments, discrete spacer rings are used to provide separation. In another described embodiment, a substantially continuous non-conductive sleeve is used to provide separation. In described embodiments, a conductive path between the inner and outer coiled tubing strings is located proximate the distal end of the coaxial coiled tubing string. The conductive path may be in the form of a conductive ring or one or more conductive cables.

Described dual-walled coiled tubing RF heating arrangements include an RF power source that is operably interconnected with the assembled inner and outer coiled tubing strings in order to provide excitation energy to the coiled tubing strings and heat them using RF energy. As the dual-walled coiled tubing RF heating arrangement is heated, portions of the formation surrounding the wellbore will also be heated, thereby stimulating flow of hydrocarbons.

Techniques are described for assembling dual-walled RF coiled tubing arrangements. According to one embodiment, a plurality of discrete non-conductive isolators are affixed to an inner coiled tubing string. In another embodiment, a non-conductive sleeve instead of discrete isolators is affixed to the inner coiled tubing string. Thereafter, the inner coiled tubing string and affixed isolator(s) are disposed within an outer coiled tubing string. A conductive path is then established between the inner and outer coiled tubing strings. The assembly is then coiled onto a reel. After injecting the coaxial coiled tubing arrangement into a wellbore, the inner and outer coiled tubing strings are associated with an RF power source or generator. Carbon steel such as that used to manufacture coiled tubing strings has a high magnetic permeability. As the frequency increases above 100 Hz, impedance increases proportional to the frequency and the correspondingly smaller skin depth induced by the magnetic field. Thus the power dissipated in the tubing will be proportional to VI[cos $\phi$] where $\phi$ is the phase angle between the applied voltage V and resulting current I. A suitable power source could use Insulated Gate Bipolar Transistors (IGBT) and/or a plurality of MOSFETS to rapidly switch the incoming power into the required frequencies while handling the produced reactive power and harmonics with opto-isolators and other techniques known to the state of the art. In addition, the front end interface to the CCT (concentric coiled tubing) may have an impedance matching system suitably configured to deal with the nonlinear variations as the real and imaginary components of the impedance change. Since the tubing itself acts as the power conducting medium in a coaxial fashion, there is no need for potentially fragile armored cabling nor cable splices. Modified wellhead designs will keep the inner and outer tubing electrically separated and insulated.

According to methods of exemplary operation, a dual-walled coiled tubing RF heating arrangement is previously made up at the surface and injected into a wellbore using coiled tubing injection equipment. The coiled tubing is injected to a desired depth and then the RF energy source is energized to heat the arrangement downhole. In some applications, once a defined amount of heating has occurred, the dual-walled coiled tubing RF heating arrangement may be withdrawn from the wellbore. A conventional production tubing string may then be disposed into the wellbore so that now stimulated hydrocarbons may be produced from the wellbore. In other applications, heating may be continued during production, and produced fluids may flow up to the surface through the inner coiled tubing string. In some embodiments, provision can be made for a production tubing string and dual-walled coiled tubing RF heater to be located in a side-by-side relation so that heating and production can occur simultaneously. This technique would be valuable for use in, paraffinic or heavy oil wellbores, for example.

Methods of operation on a larger scale contemplate use of a network made up of a plurality of wellbores. For example, a grid of wellbores may be established into a particular formation. Use of dual-walled coiled tubing RF heating arrangements in each or a number of these wellbores will collectively heat the formation to stimulate hydrocarbon flow.

In some embodiments, a dual-walled coiled tubing RF heating assembly is provided which can provide both heated and non-heated zones within a wellbore. The inventors have recognized that the heating effect provided by a dual-walled coiled tubing RF heating assembly can be altered or varied by altering the material(s) used to form the inner and/or outer tubing strings or by altering the surface composition of the inner and/or outer tubing strings of the assembly. The skin effect of heating is most pronounced in highly magnetic permeable material. Conversely, low or non-magnetically permeable material, such as austenitic stainless (e.g., 304) provide lower skin effect heating. In accordance with certain embodiments, one or more portions of a dual-walled coiled tubing RF heating assembly are constructed of a first material that is conducive to a greater degree of skin effect heating while another portion (or other portions) of the dual-walled coiled tubing RF heating assembly are constructed of a second material that provides a lesser degree of skin effect heating. For example, a dual-walled coiled tubing RF heating assembly could be constructed wherein particular lengths of the inner and outer coiled tubing strings are formed of carbon steel while other lengths of the inner and outer coiled tubing strings are formed of carbon steel (high skin effect heating) while other lengths of the inner and outer coiled tubing strings are formed of low or non-magnetic steel, such as austenitic stainless steel. These lengths of first and second materials are joined together using techniques such as welding that are known in the art for joining dissimilar metals together in a robust fashion.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

The term "dual-walled," as used herein, is intended to refer broadly to arrangements wherein an inner tubular string or member is located radially within an outer tubular string or member to provide a dual-walled tubing structure. A structure can be dual-walled without regard to whether the inner and outer tubular strings are coaxial or concentric.

Figure 1:
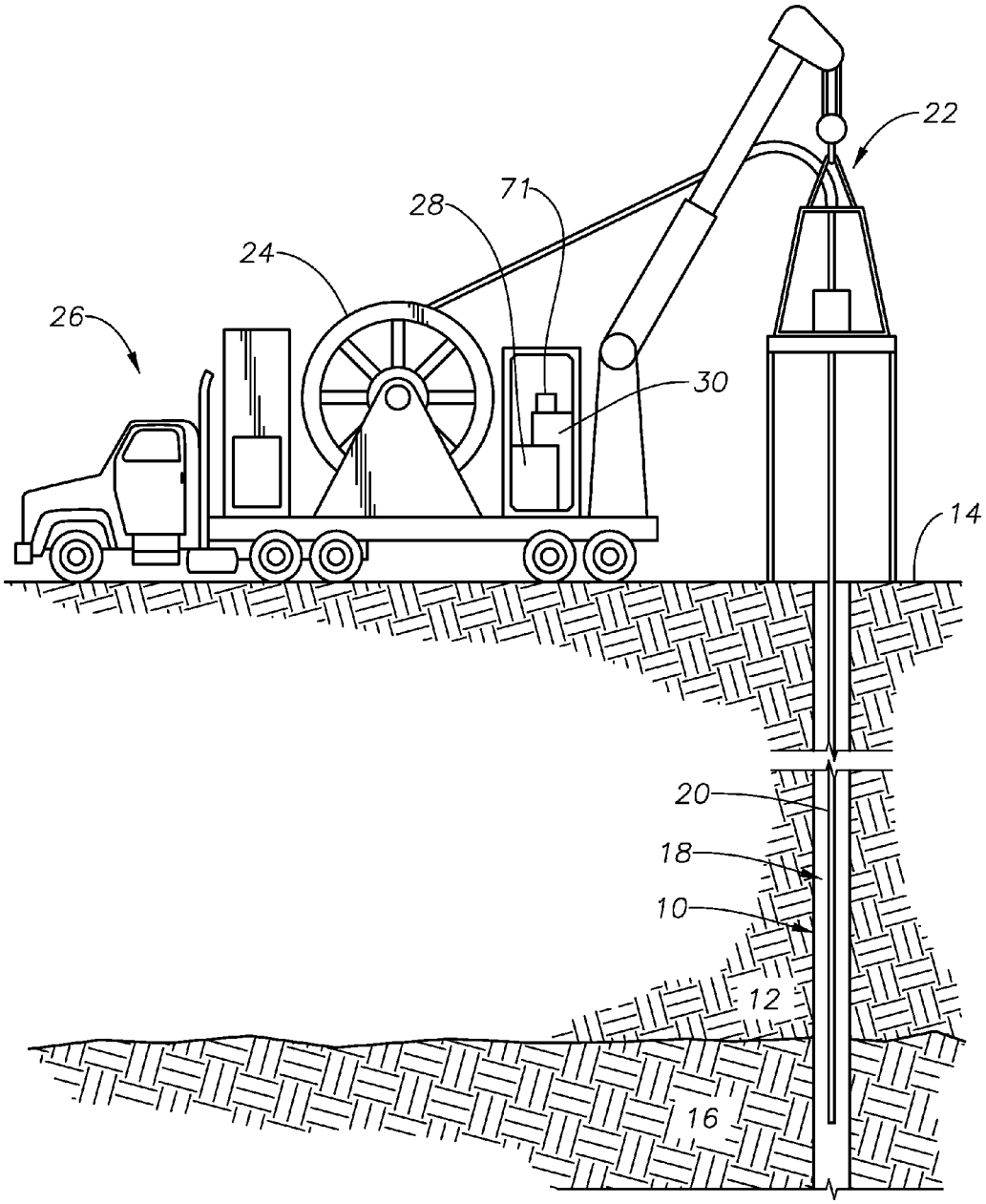
FIG. 1 is a side, cross-sectional view of a wellbore containing a dual-walled coiled tubing heating arrangement in accordance with the present invention.

FIG. 1 depicts an exemplary wellbore 10 that has been drilled through the earth 12 from the surface 14 down to a hydrocarbon-bearing formation 16. The formation 16 may be one containing heavy oil or a shale oil formation. It is desired to provide heating within the formation 16. It is noted that, while wellbore 10 is illustrated as a substantially vertical wellbore, it might, in practice, have portions that are inclined or horizontally-oriented.

A dual-walled coiled tubing RF heating arrangement 18 includes a dual-walled coiled tubing string 20 that is being disposed within the wellbore 10, being injected into the wellbore 10 from the surface 14 by a coiled tubing injection arrangement 22. The dual-walled coiled tubing string 20 is shown stored on a coiled tubing reel 24 which is mounted upon truck 26. The truck 26 is also provided with a radio frequency (RF) power source or generator 28 and motorized equipment 30 of a type known in the art to rotate the reel 24.

Figure 2:
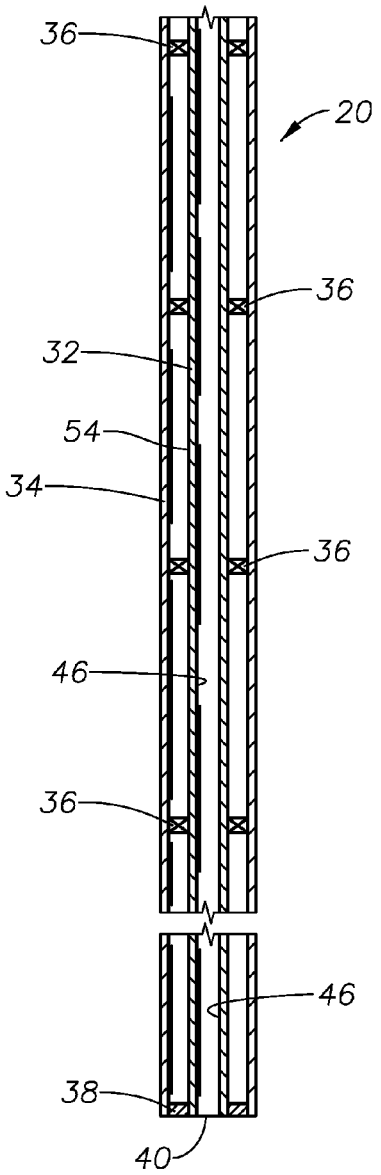
FIG. 2 is a side, cross-sectional view of a portion of the dual-walled coiled tubing heating arrangement shown in FIG. 1.

FIG. 2 depicts portions of the dual-walled coiled tubing string 20 in greater detail. The dual-walled coiled tubing string 20 includes an inner coiled tubing string 32 and an outer coiled tubing string 34. Each of these strings 32, 34 are formed of a suitable electrically conductive material, such as ferromagnetic steel or steel alloy. The inner and outer coiled tubing strings 32, 34 are separated from each other along their lengths by a plurality of isolators or separators, shown schematically at 36. In the embodiment depicted in FIG. 2, the isolators 36 are constructed so as not provide a conductive path between the inner and outer coiled tubing strings 32, 34.

Figure 8:
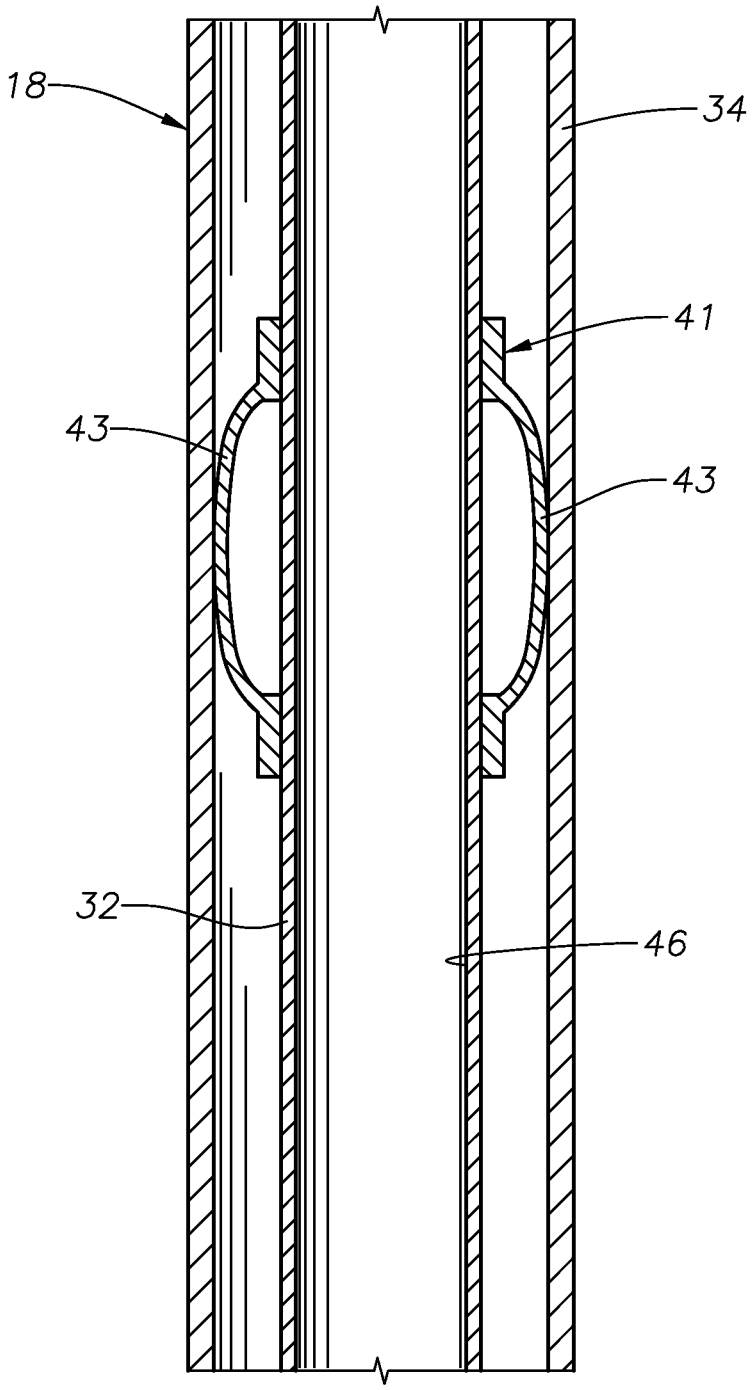
FIG. 8 is a side cross-sectional view of an exemplary distal end of a dual-walled coiled tubing heating arrangement which incorporates a conductive centralizer.

A ring 38 is located proximate the distal end 40 of the inner and outer coiled tubing strings 32, 34. It is highly preferred that the ring 38 is fixedly secured to the inner coiled tubing string 32 (such as by clamping) but is allowed to slide axially with respect to the outer coiled tubing string 34. The ring 38 provides an electromagnetic pathway between the inner coiled tubing string 32 and the outer coiled tubing string 34. It is noted that, although a ring is depicted as providing the pathway, other suitable structures might be used in its place. For example, one or more linear conductive wires might be used to provide a conductive pathway between the inner and outer coiled tubing strings 32, 34. An alternative embodiment is illustrated in FIG. 8, wherein a metallic centralizer 41 is affixed to the inner coiled tubing string 32 which has radially outwardly extending bows 43 that contact the outer tubing string 34, thereby establishing a pathway between the inner and outer coiled tubing strings 32, 34.

Figure 3:
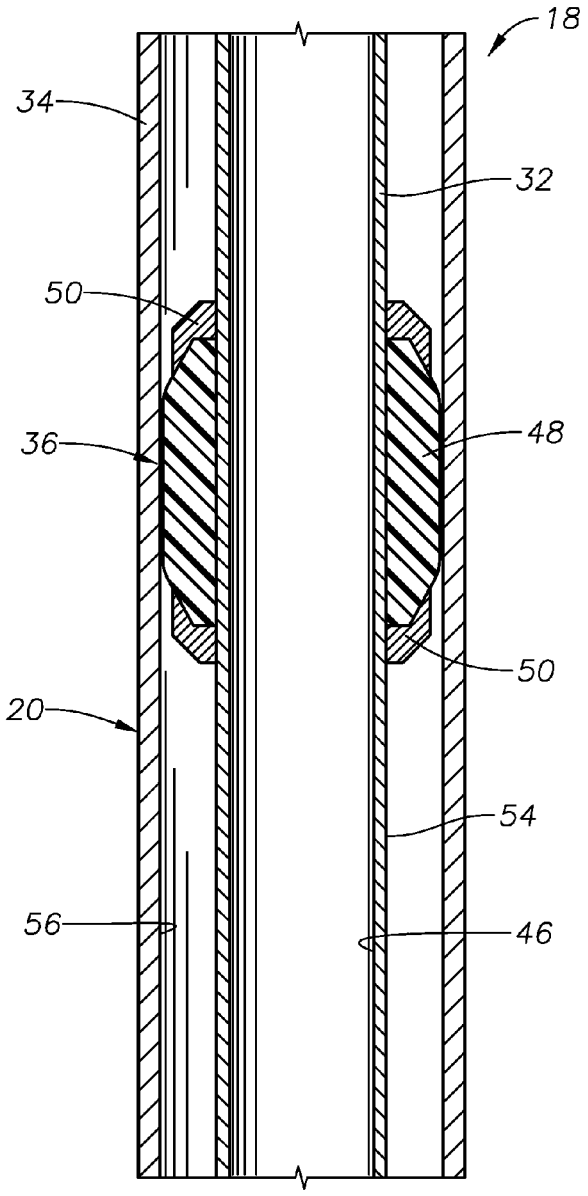
FIG. 3 is a cross-sectional detail view showing an exemplary isolator which could be used with the dual-walled coiled tubing heating arrangement shown in FIG. 2.

FIG. 3 is an enlarged cross-sectional view depicting one type of exemplary isolator 36 in greater detail. The isolator 36 includes a non-conductive separator portion 48. The separator portion 48 may be formed of, for example, ceramic, thermoplastics or elastomers. Metallic clamp rings 50 are located on each axial side of the separator portion 48 and secure the separator portion 48 to the inner coiled tubing string 32. It is preferred that the isolators 36 be affixed to the inner coiled tubing string 32 at regular spaced intervals that are sufficient to maintain complete separation of the inner and outer coiled tubing strings 32, 34 along their lengths. This separation ensures that there is no short-circuiting of the conductive pathway provided by the inner and outer coiled tubing strings 32, 34 and ring 38. In addition, arranging isolators along the tubing length assures that an air gap separates the inner and outer coiled tubing strings. Isolators may, for example, be positioned about 1 meter apart along the length of the tubing strings 32, 34 to prevent the inner tubing string 32 from sagging between isolators. An air gap of 10 mm provides a resistance to arcing of 30,000 volts. Thus, a spacing from about 1 mm to about 10 mm can provide sufficient insulation for typical voltages of from about 500 volts to about 5000 volts. Current travels on the radial exterior of the inner coiled tubing string 32 and on the inside of the outer coiled tubing string 34. The coiled tubing string material is heated by the current flowing in the surfaces of the coiled tubing strings 32, 34. The coiled tubing strings 32, 34 are connected to the RF source or generator 28 directly or via wiring. The heat produced by the dual-walled coiled tubing RF heating arrangement 18 depends upon three main factors: the induced current magnitude, the resistance of the coiled tubing material, and the time the electricity is produced.

According to preferred embodiments, the dual-walled coiled tubing RF heating arrangement is constructed so that there is a fixed electrically insulating connection between the inner and outer coiled tubing strings 32, 34 near the proximal ends (i.e., the ends of the coiled tubing strings 32, 34 that are nearest the surface 14 or wellbore 10 opening. However, the distal ends of the coiled tubing strings 32, 34 are not affixed so as to be able to slide axially with respect to one another. Allowing the distal ends of the coiled tubing strings 32, 34 to slide axially with respect to each other accommodates differential thermal expansion of the tubing strings 32, 34 during operation. For example, when one of either the inner coiled tubing string 32 or the outer coiled tubing string 34 is composed of carbon steel while the other of the inner or outer strings 32, 34 is composed of stainless steel, the differential expansion during heating may amount to 1-2 mm per meter of tubing length.

Figure 5:
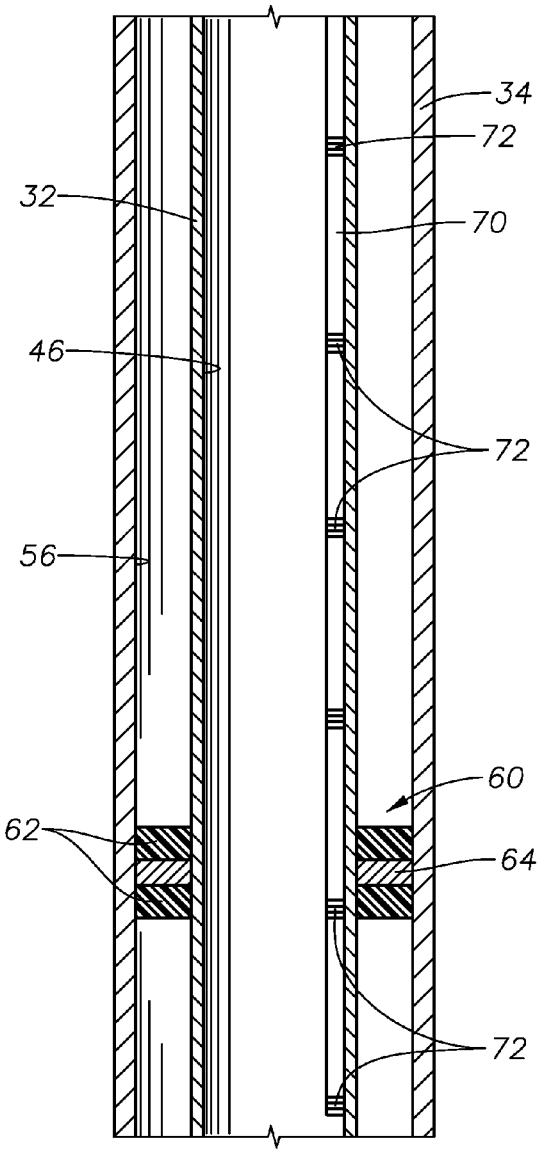
FIG. 5 is a side, cross-sectional view of an exemplary distal end of a dual-walled coiled tubing heating arrangement which incorporates a slidable packer.

Also according to certain embodiments, the distal end of the outer coiled tubing string 34 is capped or sealed to prevent wellbore fluids from entering the space between the inner coiled tubing string 32 and the outer coiled tubing string 34. A slidable packer could be used to accomplish this. FIG. 5 depicts the distal end of an exemplary dual-walled coiled tubing RF heating arrangement which includes a slidable packer element 60. The slidable packer element 60 includes elastomeric portions 62 and a conductive metallic ring portion 64. The conductive ring portion 64 is fixedly clamped to the inner coiled tubing string 32 but slidable with respect to the outer coiled tubing string 34. The elastomeric portions 62, which serve the function of blocking fluid flow, may be formed of swellable elastomers (i.e., elastomer that swells in response to fluid contact) or be inflatable elastomeric elements. According to alternative embodiments, the flowbore 46 of the inner coiled tubing string 32 is left uncapped, or open, at its distal end to permit fluids to enter the flowbore 46 or for tools or instruments to be passed through the flowbore 46.

In certain embodiments, one or more sensors or detectors for monitoring of downhole conditions are operably associated with the dual-walled coiled tubing RF heating arrangement 18. The downhole conditions to be monitored can include temperature and pressure. In one embodiment, a fiber optic monitoring cable 70 is disposed within the flowbore 46 of the inner coiled tubing string 32, as illustrated in FIG. 5. The fiber optic cable has Bragg gratings 72 along its length that are adapted to detect temperature and/or pressure at discrete locations in a manner known in the art. At surface 14, the fiber optic monitoring cable 70 is operably interconnected with an optical time domain reflectometer ("OTDR")(71 in FIG. 1) of a type known in the art, which is capable of transmitting optical pulses into the fiber optic cable and analyzing the light that is returned, reflected or scattered therein. According to other embodiments, the fiber optic monitoring cable 70 is replaced with a wireline or Telecoil-based sensor arrangement which extends along the flowbore 46 of the inner coiled tubing string 32. In accordance with alternative embodiments, the downhole condition monitoring sensor arrangement (whether fiber optic, wireline or Telecoil style) is disposed along the radial exterior of the outer coiled tubing string 34. In accordance with other alternative embodiments, the downhole condition monitoring sensor arrangement is disposed radially between the inner and outer coiled tubing strings 32, 34, and is preferably composed of non-conductive components.

An exemplary method of assembling a dual-walled coiled tubing RF heating arrangement 18 in accordance with the present invention would include an initial step of affixing a plurality of isolators 36 to an inner coiled tubing string 32. Thereafter, the inner coiled tubing string 32 with affixed isolators 36 are disposed within the outer coiled tubing string 34. The conductive ring 38 is then secured to both the inner and outer coiled tubing strings 32, 34 by welding or other suitable methods to establish a conductive path between the strings 32, 34. The dual-walled coiled tubing arrangement (including both the inner and outer coiled tubing strings 32, 34 and the conductive ring 38) is then coiled onto reel 24. Thereafter, the same dual-walled coiled tubing arrangement is injected into the wellbore 10 by coiled tubing injection arrangement 22. RF power source 28 is interconnected with the inner and outer coiled tubing strings 32, 34 and causes the inner and outer coiled tubing strings 32, 34 to be heated by excitation from the RF power source. The RF power source 28 may be any means known in the art to convert power line power to radio frequencies in the range of 500 Hz to 500,000 Hz, and may typically range from 1-20 kHz. Suitable circuitry for converting three-phase power to a square wave, for example, is described in detail in U.S. Pat. No. 8,408,294 ("Radio Frequency Technology Heater for Unconventional Resources" issued to Jack E. Bridges)(the '294 patent). A particular circuit that would be useful for this application is illustrated in FIG. 11 of the '294 patent. The RF power source or heater in that instance would be represented by the inductance 451 and the resistance 452 (in FIG. 11 of the '294 patent). The positive output terminal, represented by the wire connected to the inductance 451 is connected by a wire or cable to the inner coiled tubing string 32 of the dual-walled coiled tubing RF heating arrangement 18, and the ground terminal is connected to the outer coiled tubing string 34 at the wellhead. Current then flows down the inner coiled tubing string 32 to its distal end and, through the conductive pathway (i.e., ring 38), back up the outer coiled tubing string 34.

A magnetic field inducted by the current repels the electrons toward the surfaces of the inner and outer coiled tubing strings 32, 34 so that current flows in a thin skin on the outside of the inner coiled tubing string 32 and the inside of the outer coiled tubing string 34. This flow pattern reduces the cross-sectional area needed for current to flow, thus increasing the electrical resistance and the heating effect. Further details relating to skin effect heating are described in the '294 patent in columns 5-6.

Figure 4:
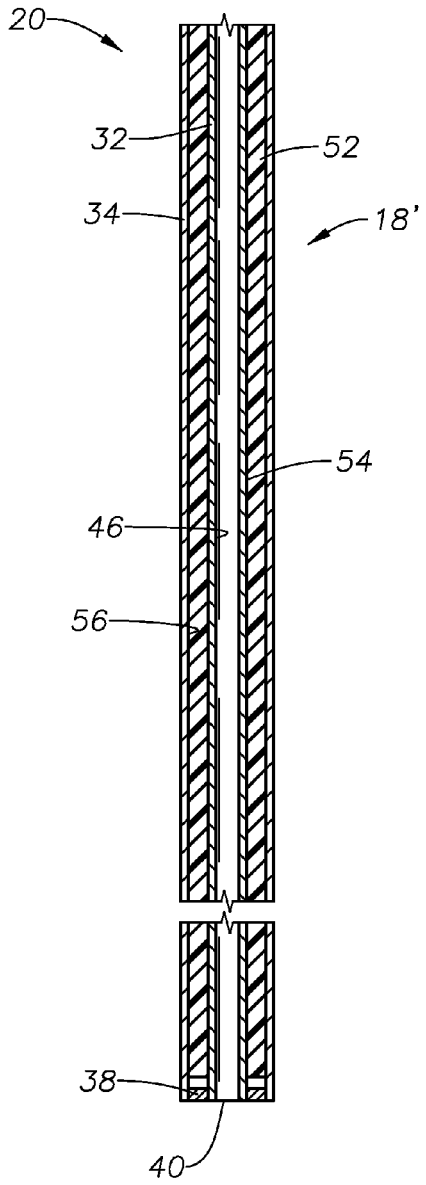
FIG. 4 is a side, cross-sectional view of a portion of an alternative construction for a dual-walled coiled tubing heating arrangement.

FIG. 4 illustrates an alternative embodiment for a dual-walled coiled tubing heating arrangement 18' wherein the discrete isolators 36 have been replaced with a unitary non-conductive sleeve 52. In the depicted embodiment, the sleeve 52 is formed of elastomer and, preferably, elastomeric foam. However, other electrically non-conductive materials might be used as well.

In further alternative embodiments for a dual-walled coiled tubing arrangement, the isolators 36 or sleeve 52 are replaced by a non-conductive coating that is applied to either or both of the outer radial surface 54 of inner coiled tubing string 32 and/or the inner radial surface 56 of the outer coiled tubing string 34. In other embodiments, a suitable non-conductive pressurized sand or powder could provide an insulative layer between the inner and outer coiled tubing strings 32, 34.

An RF electric heating arrangement must provide sufficient resistance so that the flowing current can produce heat according to $i^2R$, where I is the current flowing and R is electrical resistance, or the real part of the impedance Z. By using a RF power source 28 with ferromagnetic steel, a magnetic field is generated which causes the current to flow in a thin skin on the inner radial surface 56 of the outer coiled tubing string 34 and the outer radial surface 54 of the inner coiled tubing string 32 where it meets high resistance because of the small cross-sectional area of the flow path. Since essentially no current flows on the outside of the outer coiled tubing string 34, electrolytic corrosion is prevented. Because use of standard, commercially-available coiled tubing strings meets oil well strength standards, the dual-walled coiled tubing RF heating arrangement 18 or 18' is robust. The inner and outer coiled tubing strings 32, 34 become a heating element which will impart heat to fluids within the wellbore 10 and transmit heat to the surrounding formation.

Starting with the ambient formation temperature and factoring in the specific heat capacity of the target fluid one can determine the requisite joules required to, for instance, lower the viscosity of the target fluid to a specified range or value. Calculating joules over time will yield a watt quantity needed or heat balance methods might also be used to determine the amount of power required. Two examples are provided to explain:

Example A: Heavy oil with initial API gravity of 10-12, with an initial viscosity of 350 cp at the reservoir temperature of 40-45° C. needs to have its temperature raised approximately 45° C. to lower the viscosity of the oil sufficiently to mobilize it within the wellbore and enable reliable pumping. If the payzone is 60 meters and only the payzone will be heated, the power requirement will be on the order of 25 Kw.

Example B: Oil sands having a volumetric heat capacity of 2780 kJ/$m^3$ needs to have temperature raised 80° C. over a 1000 meter horizontal section. The target temperature and volume requires approximately 150 W/m. Given the potential losses along the path, the power required should be about 180 kW.

Dual-walled coiled tubing RF heating arrangements, such as 18, 18' could be used to stimulate production of heavier hydrocarbons in portions of the formation 16 surrounding the wellbore 10. According to an exemplary method of operation, a dual-walled coiled tubing heating arrangement 18 or 18' is injected into the wellbore 10 using the injection arrangement 22. The generator 28 is then activated to supply electrical current to the coiled tubing strings 32, 34, thereby causing the dual-walled coiled tubing heating arrangement 18 or 18' to heat up and heat the formation 16 radially surrounding the wellbore 10. By way of example, 300 KWhr per meter of well length may heat a typical reservoir rock formation in a gradient of temperatures around the wellbore from 200° C. at the wellbore to about 40° C. at a radial distance of 2 meters, requiring a power input of around 100 W/meter for a period of four months.

After a defined amount of heating has occurred, the dual-walled coiled tubing heating arrangement 18 or 18' may be removed from the wellbore 10. Whether a defined amount of heating has occurred may be determined using a number of techniques. For example, a defined amount of heating might be considered to have occurred after the dual-walled coiled tubing heating arrangement 18 or 18' has been energized within the wellbore 10 for a predetermined period of time. Alternatively, an operator might dispose one or more temperature sensors within the wellbore 10 so that the detected wellbore temperature can be transmitted to surface 14. A defined amount of heating could then be considered to have occurred after the detected wellbore temperature is at least a certain temperature for a predetermined amount of time. Heating of the wellbore 10 and portions of the formation 16 surrounding the wellbore 10 will promote flow of hydrocarbons within the formation 16, particularly heavier oil, paraffin and the like. After the reservoir reaches a desired temperature, electrical heating may be continued to continuously raise the temperature of the produced hydrocarbons so as to maintain their low viscosity and promote continual flow. For example, the temperature of oil flowing into the well can be continually raised from 20° to 120° C. by a heat production of 80 W/m of heated well length. The oil can be produced to the surface through the inner coiled tubing string 32 by conventional techniques.

In another example, following withdrawal of the dual-walled coiled tubing heating arrangement 18 or 18' from the wellbore 10, steam injection equipment may be inserted into the wellbore to supply heat for produced oil using any one of a number of steam heating methods known in the art. Preheating by the coiled tubing heater may improve the uniformity of flow of steam into the formation. For example, when two horizontal wells are arranged in the manner typical for steam-assisted gravity drainage, uniformity of injection into one or both of the wells may be improved.

Stimulation of a formation and subsequent production might be used on a larger scale through a network made up of a plurality of wellbores. For example, a grid of wellbores may be established into a particular formation. Use of dual-walled coiled tubing RF heating arrangements in each or a number of these wellbores will collectively heat the formation to stimulate hydrocarbon flow. It is also envisioned that one or more dual-walled coiled tubing heating arrangements, such as 18 or 18' might be operated on a substantially continuous basis in some of the wellbores to heat and stimulate the formation while other nearby wellbores in the same formation are used to produce hydrocarbons from the formation.

Figure 6:
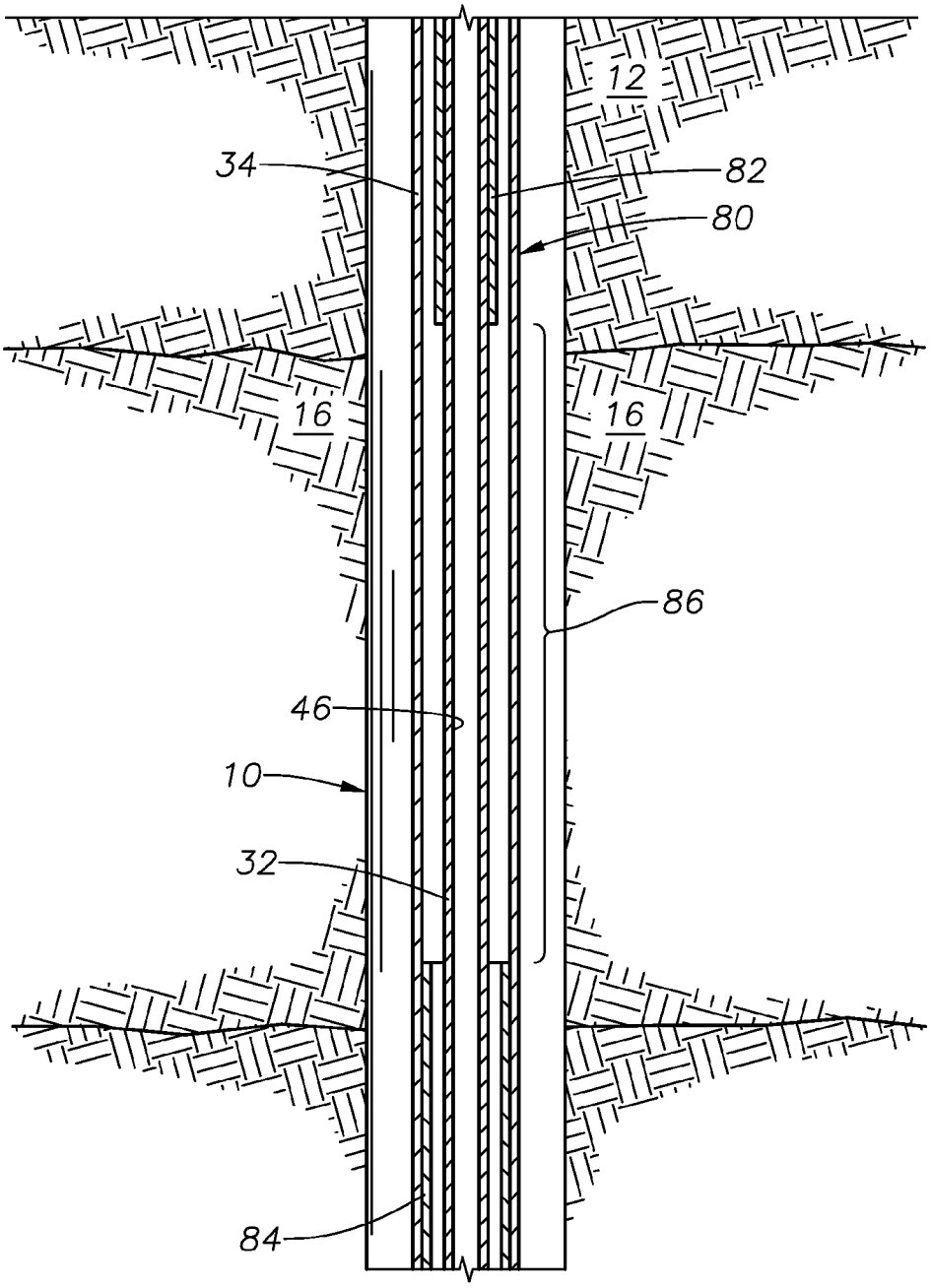
FIG. 6 is a side, cross-sectional view depicting an exemplary dual-walled coiled tubing heating arrangement which incorporates metallic linings of different composition from the coiled tubing string it is affixed to in order to alter the heating properties of certain portions of the heating arrangement.

According to other embodiments of the invention, portions of the length of a dual-walled coiled tubing RF heater arrangement have different electromagnetic properties. In particular embodiments, strips of metal with different properties for propagating electromagnetic energy are affixed to the coiled tubing strings. The magnitude of heating in each tubing string (32 or 34) is determined by the impedance Z of the skin layer. Since the magnetic permeability $\mu$ of the tubing material and the electrical conductivity a both affect the skin depth, the amount of heating in each tube can be varied by choosing an appropriate metal for the tubing or a liner. Typically the outer tubing string 34 to be heated may be fabricated from ordinary carbon steel, whereas the inner tubing string 32 may be carbon steel if heating of the inner tubing string 32 is desired, or a non-magnetic metal such as stainless steel having low magnetic permeability if the inner tubing string 32 heating is preferred to be minimally heated. The relative magnetic permeability of steel ranges from 100 to several thousand, while that of type 304 stainless steel is typically 1.006 and of aluminum or copper is essentially 1.0. The conductivity of steel is typically $5.6\times10^4$/ohm-cm, while type 304 stainless steel is $1.4\times10^4$ and aluminum is $27\times10^4$. Therefore, alternatively, the tubing preferred to be unheated may be lined with aluminum or copper of a thickness comparable to the skin depth, which may amount to a fraction of a millimeter to several millimeters depending on the magnetic permeability of the material. Metal lining may be attached by electroplating or by a process known in the art as roll-bonding before the strips are formed into tubing by the tubing forming process. It should be attached on the inside of the outer tubing string 34 and/or the outside of the inner tube 32, where the skin layer is located. FIG. 6 illustrates a dual-walled coiled tubing RF heating assembly 80 which is constructed and operates in the same manner as heating assembly 18 described earlier except as noted herein. The RF heating assembly 80 includes inner and outer coiled tubing strings 32, 34. No isolators are being depicted in FIG. 6 for clarity, although it should be understood that isolators are preferably used. However, an outer aluminum liner 82 overlies an upper portion of the outer radial surface of the inner coiled tubing string 32. In addition, an inner aluminum liner 84 overlies a lower portion of the inner radial surface of the outer coiled tubing string 34. The portions of the dual-walled coiled tubing RF heating assembly 80 that include liners 82 or 84 are positioned adjacent portions of the earth 12 which it is not desired to heat. The portion 86 of the dual-walled coiled tubing RF heating assembly 80 which does not include either liners 82 or 84 along its length is positioned adjacent the formation 16 which it is desired to heat. The differential structure of the dual-walled coiled tubing RF heating assembly 80 provides an increased level of RF heating by portion 86 versus the portions which are lined with liner 82 or 84.

Figure 7:
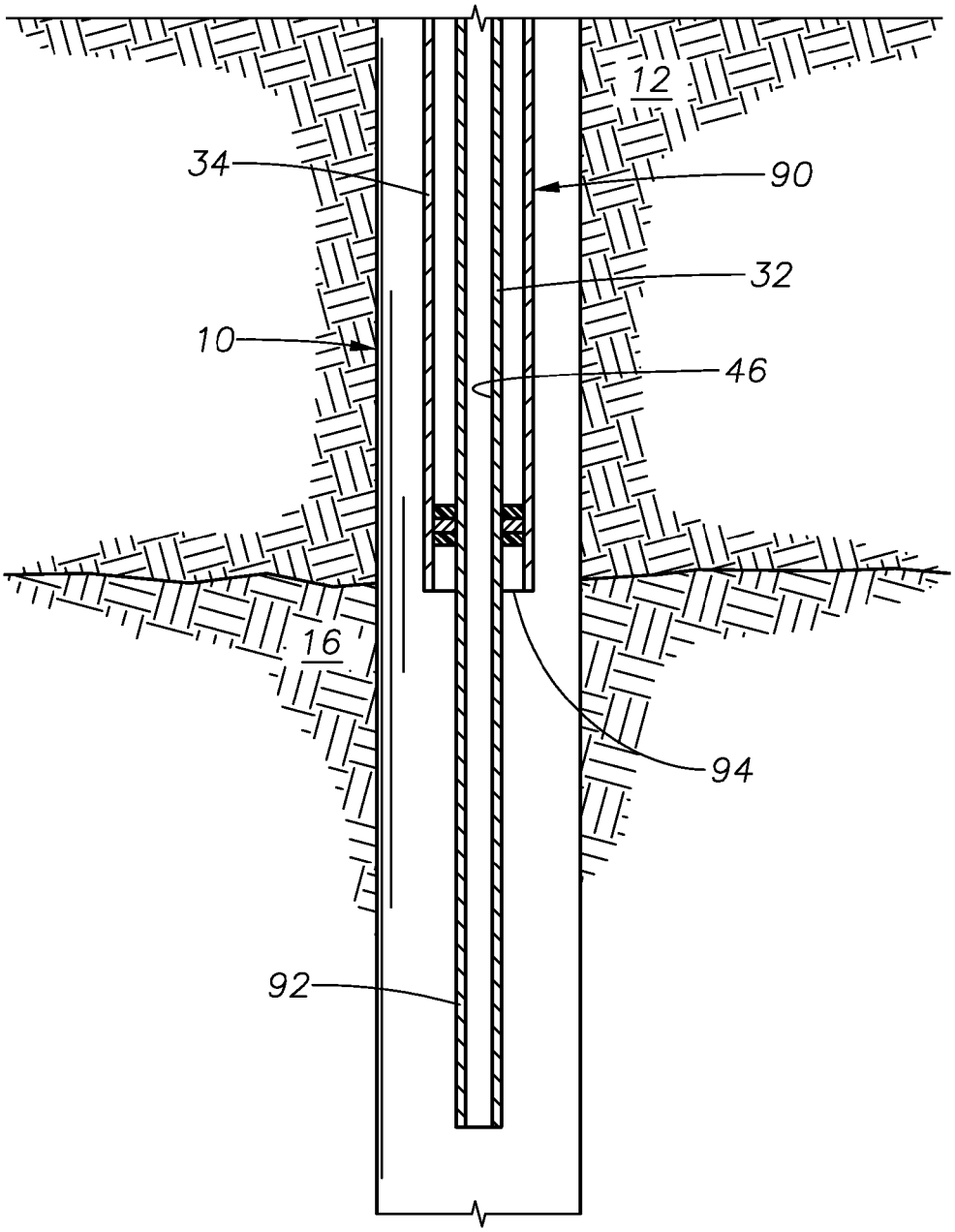
FIG. 7 is a side, cross-sectional drawing depicting a dual-walled coiled tubing RF heating arrangement having an elongated, axially extending portion of the inner coiled tubing string to provide for dipole heating.

In the embodiment described above, the heating is generated within the material of the coiled tubing strings 32, 34 and can then flow out into the formation 16 surrounding the wellbore 10. In further embodiments, the dual-walled coiled tubing RF heating assembly 18 or 18' can be arranged to radiate RF waves into the surrounding reservoir to heat the reservoir directly. This can be done by extending the length of the inner coiled tubing string 32 beyond the distal end of the outer coiled tubing string 34, as depicted in FIG. 7. In FIG. 7, a dual-walled coiled tubing RF heating assembly 90 includes an inner coiled tubing string 32 and an outer coiled tubing string 34. The inner coiled tubing string 32 has an elongated portion 92 which extends beyond the distal end 94 of the outer coiled tubing string 34. The elongated, protruding portion 92 should be located adjacent a formation 16 which it is desired to heat. The elongated, protruding portion 92 of the inner coiled tubing string 32 forms one pole of a dipole antenna. The other pole of the dipole antenna is formed by the outer coiled tubing string 34. In this configuration, heating largely propagates into the surrounding formation 16 from the elongated portion 92 of the inner coiled tubing string 32. An advantage of this type of dipole arrangement is that the heating is unaffected by flow of fluids in the formation, which may carry heat back to into the well and thus reduce the rate of heat flow from the wellbore 10.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A dual-walled coiled tubing heating arrangement for stimulation of subterranean hydrocarbon production, the arrangement comprising:

an inner coiled tubing string defining a flowbore along a length of the inner coiled tubing string;

an outer coiled tubing string radially surrounding the inner coiled tubing string;

an electrically conductive pathway interconnecting the inner and outer coiled tubing strings;

a radio frequency power source to provide electrical energy to the inner and outer coiled tubing strings to cause said inner and outer coiled tubing strings to heat a surrounding subterranean formation; and a downhole condition monitoring arrangement operably associated with the inner and outer coiled tubing strings to detect one or more downhole conditions, the downhole condition monitoring system having:

a fiber optic cable having a plurality of Bragg grating sensors; and an optical time domain reflectometer which is operably interconnected with the fiber optic cable for transmitting optical pulses into the fiber optic cable and analyzing the light that is returned, reflected or scattered therein.

2. The dual-walled coiled tubing heating arrangement of claim 1 further comprising an isolator disposed radially between the inner and outer coiled tubing strings to ensure separation of the inner and outer coiled tubing strings.

3. The dual-walled coiled tubing heating arrangement of claim 2 wherein the isolator comprises a plurality of discrete spacer rings formed of non-conductive material.

4. The dual-walled coiled tubing heating arrangement of claim 2 wherein the isolator comprises a spacer sleeve formed of non-conductive material.

5. The dual-walled coiled tubing heating arrangement of claim 2 wherein the isolator comprises a non-conductive coating disposed upon at least one of: an outer radial surface of the inner coiled tubing string, and an inner radial surface of the outer coiled tubing string.

6. The dual-walled coiled tubing heating arrangement of claim 1 wherein the electrically conductive pathway comprises a conductive ring secured to both the inner and outer coiled tubing strings.

7. The dual-walled coiled tubing heating arrangement of claim 1 wherein the electrically conductive pathway comprises a conductive centralizer that is affixed to the inner coiled tubing string, the centralizer having radially outwardly extending bows contacting the outer coiled tubing string.

8. The dual-walled coiled tubing heating arrangement of claim 1 further comprising:

a space defined radially between the inner coiled tubing string and the outer coiled tubing string; and the space is sealed near the distal ends of the inner and outer coiled tubing strings.

9. The dual-walled coiled tubing heating arrangement of claim 8 wherein the space is sealed with a slidable packer.

10. The dual-walled coiled tubing heating arrangement of claim 1 wherein:

the outer coiled tubing string having a distal end; and the inner coiled tubing string presents an elongated portion which protrudes beyond the distal end of the outer coiled tubing string.

11. The dual-walled coiled tubing heating arrangement of claim 1 wherein:

a metallic liner overlies a portion of either an outer radial surface of the inner coiled tubing string or an inner radial surface of the outer coiled tubing string; and the portion of the dual-walled coiled tubing heating arrangement which includes a liner provides for a reduced amount of heating for the formation.

12. A dual-walled coiled tubing heating arrangement for stimulation of subterranean hydrocarbon production, the arrangement comprising:

an inner coiled tubing string defining a flowbore along a length of the inner coiled tubing string;

an outer coiled tubing string radially surrounding the inner coiled tubing string;

an electrically conductive pathway interconnecting the inner and outer coiled tubing strings;

a radio frequency power source to provide electrical energy to the inner and outer coiled tubing strings to cause the inner and outer coiled tubing strings to heat a surrounding subterranean formation;

an isolator disposed radially between the inner and outer coiled tubing strings to ensure separation of the inner and outer coiled tubing strings;

a space defined radially between the inner coiled tubing string and the outer coiled tubing string; and the space is sealed near the distal ends of the inner and outer coiled tubing strings with a slidable packer.

13. The dual-walled coiled tubing heating arrangement of claim 12 further comprising a downhole condition monitoring arrangement operably associated with the inner and outer coiled tubing strings to detect one or more downhole conditions.

14. The dual-walled coiled tubing heating arrangement of claim 12 wherein the electrically conductive pathway comprises a conductive centralizer that is affixed to the inner coiled tubing string, the centralizer having radially outwardly extending bows contacting the outer coiled tubing string.

15. A method of stimulating hydrocarbon production from a subterranean formation by heating, the method comprising the steps of:

forming a dual-walled coiled tubing assembly having an inner coiled tubing string, an outer coiled tubing string which radially surrounds the inner coiled tubing string, and a conductive path between the inner and outer coiled tubing strings;

injecting the dual-walled coiled tubing assembly into a wellbore;

operably associating a radio frequency power source with the inner and outer coiled tubing strings;

energizing the dual-walled coiled tubing assembly with the radio frequency power source to cause the dual-walled coiled tubing assembly to propagate radio frequency heating to the formation; and detecting one or more downhole conditions with a downhole condition monitoring arrangement which is operably associated with the inner and outer coiled tubing strings and having a fiber optic cable with a plurality of Bragg grating sensors and an optical time domain reflectometer which is operably interconnected with the fiber optic cable for transmitting optical pulses into the fiber optic cable and analyzing the light that is returned, reflected or scattered therein.

16. The method of claim 15 further comprising the step of coiling the dual-walled coiled tubing assembly onto a coiled tubing reel prior to injecting the dual-walled coiled tubing assembly into the wellbore.

17. The method of claim 15 wherein:

the inner coiled tubing string includes an elongated portion which protrudes axially beyond a distal end of the outer coiled tubing string; and wherein the elongated portion propagates heating into the formation.

* * * * *